US006511363B2

(12) United States Patent
Yamane et al.

(10) Patent No.: US 6,511,363 B2
(45) Date of Patent: Jan. 28, 2003

(54) POLISHING END POINT DETECTING DEVICE FOR WAFER POLISHING APPARATUS

(75) Inventors: Akihiko Yamane, Mitaka (JP); Osamu Matsushita, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 10/021,007

(22) Filed: Dec. 19, 2001

(65) Prior Publication Data

US 2002/0115380 A1 Aug. 22, 2002

(30) Foreign Application Priority Data

Dec. 27, 2000 (JP) ..... 2000-397632
Dec. 4, 2001 (JP) ..... 2001-369503

(51) Int. Cl.[7] ..... B24B 49/00

(52) U.S. Cl. ..... 451/6; 451/5; 451/41; 451/287

(58) Field of Search ..... 451/6, 5, 41, 288, 451/287, 398

(56) References Cited

U.S. PATENT DOCUMENTS 6,000,996 A * 12/1999 Fujiwara
6,190,234 B1 * 2/2001 Swedek et al.

FOREIGN PATENT DOCUMENTS

JP 2000-183001 6/2000
JP 2000-186918 7/2000

* cited by examiner

*Primary Examiner*—M. Rachuba
*Assistant Examiner*—Willie Berry, Jr.
(74) *Attorney, Agent, or Firm*—Nixon Peabody LLP; David S. Safran

(57) ABSTRACT

White light from a light source is applied onto a wafer through an observation window which is formed on a polishing pad, and a spectrometric analysis is performed to the light which has been reflected on the wafer, whereby a polishing end point of the wafer is detected. In this case, an amount of the reflected light is measured and brightness of the light source is corrected so that the amount of the reflected light is constant. Thereby, the polishing end point is accurately detected.

43 Claims, 9 Drawing Sheets

POLISHING END POINT DETECTING DEVICE FOR WAFER POLISHING APPARATUS

BACKGROUND OF THE INVENTION

Field of the Invention

The present invention relates to a polishing end point detecting device for a wafer polishing apparatus, specifically to a polishing end point detecting device for a wafer polishing apparatus which polishes the wafer by Chemical Mechanical Polishing (CMP).

Description of Related Art

The CMP is often used in a manufacturing process of large scale integrated circuits (LSI) in order to polish an insulator film or a metal film. In this process, an accurate determination of a polishing end point is required.

One conventional example of the CMP is Japanese Patent Application Publication No.2000-186918, which discloses a method in which light is applied onto a polishing face of the wafer and a spectrum intensity distribution of the light reflected on the polishing face is measured whereby a polishing end point is detected. Another example is Japanese Patent Application Publication No.2000-183001 disclosing a method in which light is applied onto the polishing face of the wafer and a color component of the light reflected on the polishing face is detected whereby the polishing end point is detected. Still another example is a method in which light of a single wavelength is applied onto the wafer, and the polishing end point is detected by referring to variations of an intensity of the reflected light.

Japanese Patent Application Publication No.2000-186918 discloses a method in which a lens makes the light from a light source parallel light, that is applied onto the polishing face of the wafer, and only zero degree light (regular reflection light) reflected on the polishing face is selected out by a light shielding slit, then the spectrum intensity distribution of the separated light is measured. After that the measured spectrum intensity distribution is fitted with spectrum characteristics that have been stored beforehand; thereby the polishing end point is detected.

On the other hand, Japanese Patent Application Publication No.2000-183001 discloses a polishing end point detecting method in which light from the light source is conducted to the polishing face by the light guide so as to illuminate the polishing face, and the light reflected on the polishing face is then conducted into a color identification sensor by the light guide, whereby a color component of the reflected light is detected. Then, the detected color component is fitted with a reference color component that has been stored beforehand, whereby the polishing end point is detected.

However, the polishing end point detecting method of Japanese Patent Application Publication No.2000-186918 has a problem in that it requires the light for illuminating the polishing face to be strictly parallel light for which an optical adjustment is difficult. Moreover, since the regular reflection light forms an image at the outside of the light shielding slit by a slight inclination of a reflection surface or an aberration of a condenser optical system, an amount of the regular reflection light is reduced that passes through the narrow light shielding slit and thus an intensity of the light to be used for detecting is lowered, resulting in poor sensitivity. Further, the polishing end point detecting method also requires an illumination/light receiving optical system which uses a beam splitter for splitting applied light and reflected light, hence the light is not used efficiently.

The polishing end point detecting method disclosed in Japanese Patent Application Publication No.2000-183001 also has a disadvantage in that it cannot precisely analyze the color components of RGB since the color components are detected without splitting the reflected light by the color identification sensor. Consequently, the polishing end point cannot be accurately detected.

Moreover, in a method for detecting the polishing end point by using the light of a single wavelength, an erroneous determination often occurs because the polishing end point is detected by referring to data from a single source.

SUMMARY OF THE INVENTION

It is an object of the present invention to provide a polishing end point detecting device for a wafer polishing apparatus which can accurately detect a polishing end point.

In order to achieve the above-described object, the present invention provides a polishing end point detecting device for a wafer polishing apparatus, comprising: a light source; a light guide at an illuminating side which conducts light outputted from the light source onto a polishing face of a wafer so as to illuminate the polishing face; a light guide at a light receiving side which conducts the light being reflected on the polishing face of the wafer after having been led from the light guide at the illuminating side onto the polishing face of the wafer; a spectroscope for splitting the light conducted by the light guide at the light receiving side into lights for corresponding wavelengths; a photoelectric converting device for converting the light having been split by the spectroscope into electric signals corresponding with a light intensity of each of the wavelengths, and outputting the converted lights as light intensity signals for the corresponding wavelengths; and an end point determination device for determining a polishing end point in accordance with the light intensity signals for the corresponding wavelengths that have been outputted from the photoelectric converting device.

According to the present invention, illumination light is conducted and reflected light is picked up by using the light guide at the illuminating side and a light guide at the light receiving side; thus light can be more efficiently used and the detecting accuracy improves as compared with a case using a beam splitter. Moreover, the polishing end point detecting device can also prevent the detecting accuracy from being lowered due to a displaced optical alignment. Further, since the reflected light having been picked up is split by the spectroscope, and the polishing end point is detected in accordance with the light intensity distribution for corresponding wavelengths of the split light, the color components of the reflected light can be precisely analyzed, and thus the polishing end point can be accurately detected.

In order to achieve the above-described objects, the present invention provides a polishing end point detecting method for a wafer polishing apparatus, in which a wafer is pressed against a polishing pad and the wafer is polished by sliding the wafer and the polishing pad each other while supplying slurry; wherein white light is applied onto the wafer which is being polished from the light source through a window that is formed on the polishing pad, and a spectrometric analysis is performed to the light that is reflected on the wafer, whereby the polishing end point of the wafer is detected.

According to the present invention, the white light is applied onto a wafer which is being polished, and a spectrometric analysis is performed to the reflected light so as to detect the polishing end point of the wafer. Therefore, more data is available which can be used for detecting the polishing end point as compared with a case for detecting the polishing end point with light of a single wavelength, and hence the polishing end point can be accurately detected.

In order to achieve the above-described objects, the present invention provides the polishing end point detecting method for the wafer polishing apparatus, wherein the spectrometric analysis comprises the following steps: a light intensity spectrum of the reflected light is measured; a ratio between the light intensity spectrum of the reflected light and a light intensity spectrum of the reflected light of a reference sample which has been obtained beforehand is obtained; and the polishing end point is detected based on the obtained ratio.

According to the present invention, the light intensity spectrum of the reflected light is measured, and a ratio is obtained between the light intensity spectrum of the reflected light and the light intensity spectrum of the reflected light from the reference sample that has been obtained beforehand, then the polishing end point is detected based on the ratio. Therefore, the present invention can detect the polishing end point even more accurately than a conventional device and method.

Further, in order to achieve the above-described objects, the present invention provides the polishing end point detecting method for the wafer polishing apparatus, wherein an amount of the reflected light is measured, and brightness of the light source is corrected so that the amount of the reflected light is constant.

According to the present invention, variations in an amount of reflected light due to changes in transmittance of the window with a different surface condition can be corrected, and an amount of reflected light is always maintained constant; thereby, the polishing end point can always be detected accurately.

In order to achieve the above-described objects, the present invention provides the polishing end point detecting method for the wafer polishing apparatus, wherein the light intensity spectrum of the reflected light from the reference sample is corrected in accordance with the brightness of the light source that has been corrected.

According to the present invention, the light intensity spectrum of the reflected light from the reference sample is corrected in accordance with changes of the brightness of the light source; thus the polishing end point can be detected even more accurately than the conventional method and device.

Furthermore, in order to achieve the above-described objects, the present invention provides the polishing end point detecting method for the wafer polishing apparatus, wherein the brightness of the light source is corrected by changing an amount of electricity to be supplied to the light source.

According to the present invention, the brightness of the light source is corrected by changing an amount of electricity to be supplied to the light source.

In order to achieve the above-described objects, the present invention provides the polishing end point detecting method for the wafer polishing apparatus, wherein the brightness of the light source is corrected through the following steps: providing plural light sources with different brightnesses; and selecting one of the light sources to light up.

According to the present invention, plural light sources with different brightnesses are provided, and one of the light sources is selected to light up so as to correct the brightness of the light source.

As described hereinabove, according to the present invention, the reflected light which has been applied on the polishing face of the wafer is split by the spectroscope, and the polishing end point is determined in accordance with the light intensity distribution for corresponding wavelengths of the split lights. Therefore, the color component of the reflected light can be precisely analyzed and the polishing end point can be accurately detected. Moreover, the applied light is conducted and the reflected light is picked up by using the light guide at the illuminating side and the light guide at the light receiving side; thus, the light can be more efficiently used and the detecting accuracy improves as compared with the case using a beam splitter, and at the same time the detecting accuracy is effectively prevented from being lowered due to a displaced optical alignment.

Moreover, according to the present invention, the white light is applied onto a wafer which is being polished, and a spectrometric analysis is performed to the reflected light so as to detect the polishing end point of the wafer. Therefore, more data is available which can be used for detecting the polishing end point as compared with a case for detecting the polishing end point with light of a single wavelength, and hence the polishing end point can be accurately detected.

Furthermore, variations in an amount of reflected light due to changes in transmittance of the window with a different surface condition can be corrected, and an amount of reflected light is always maintained constant; thereby, the polishing end point can always be detected accurately.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Hereunder a preferred embodiment for a polishing end point detecting device for a wafer polishing apparatus will be described in detail in accordance with the accompanying drawings.

Figure 1:
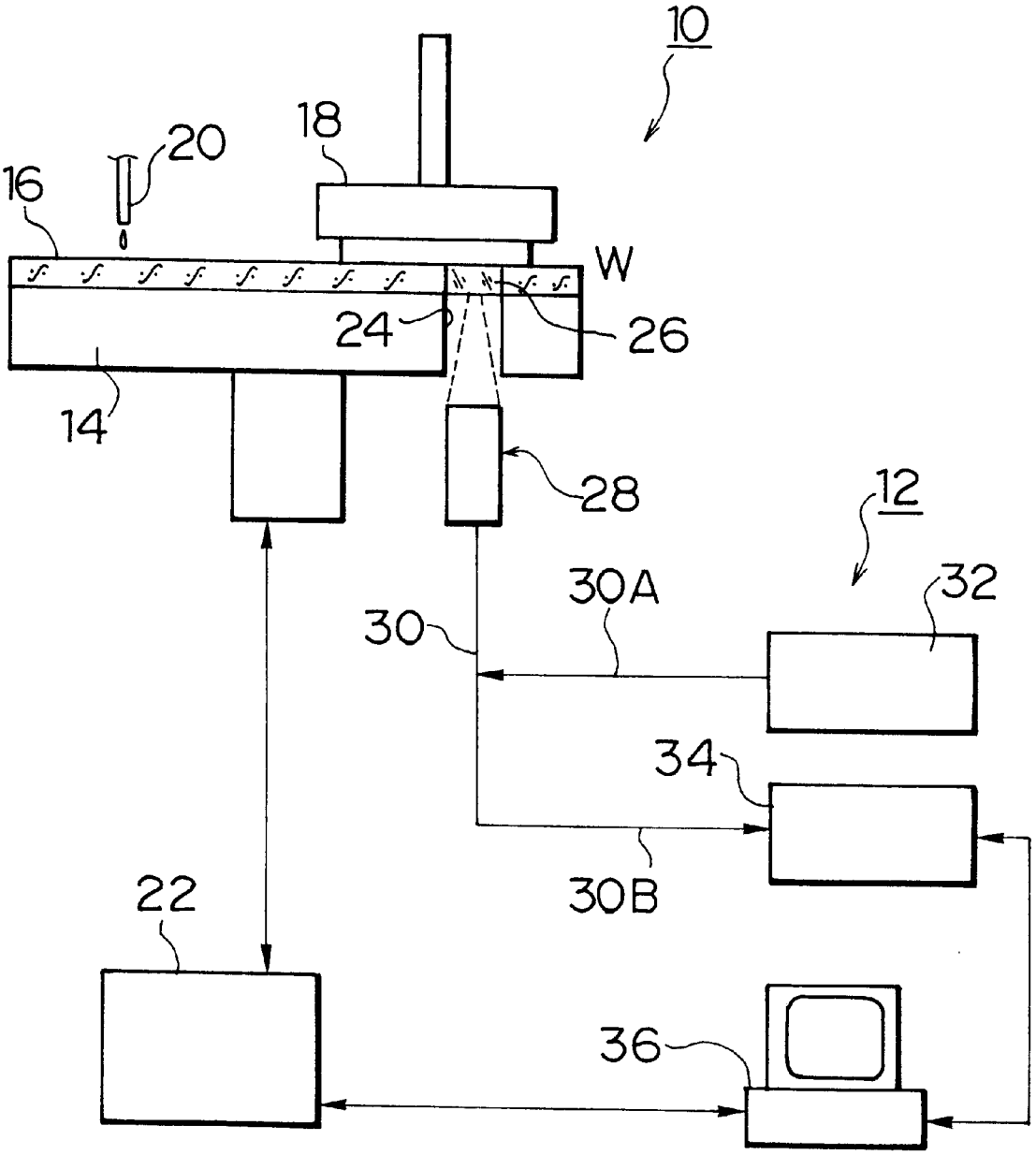
FIG. 1 is a block diagram showing a structure of a polishing end point detecting device for a wafer polishing apparatus in a first embodiment of the present invention.
Figure 2:
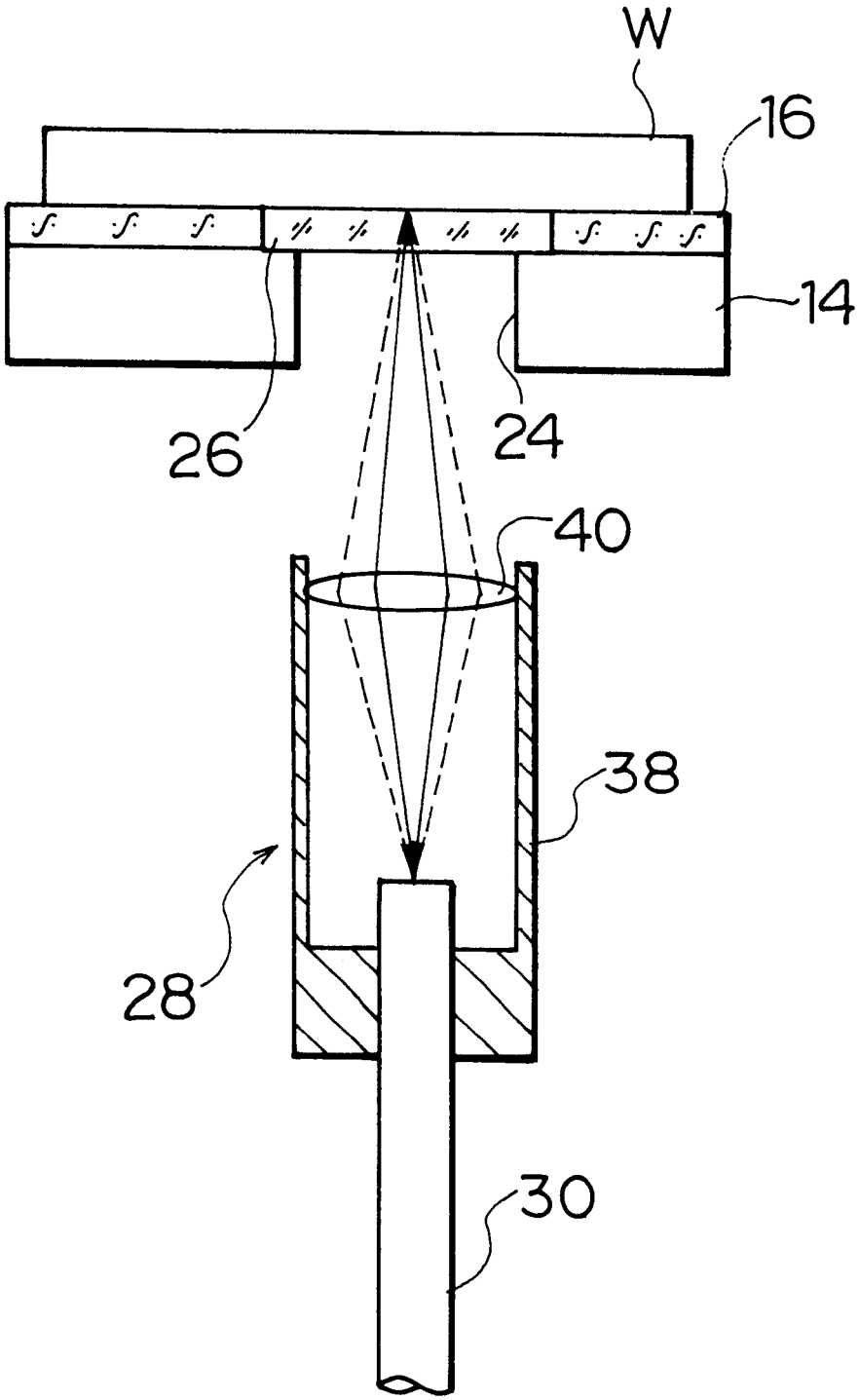
FIG. 2 is a schematic view showing a structure of an illumination/light receiving system.

FIG. 1 is a block diagram showing a structure of a polishing end point detecting device for a wafer polishing apparatus in a first embodiment of the present invention.

A wafer polishing apparatus 10 comprises a platen 14 which is driven and rotated horizontally by a motor (not shown), a polishing pad 16 which is adhered to a surface of the platen 14, a wafer holding head 18 which holds a wafer W and presses the wafer W against the polishing pad 16 in a predetermined pressure, a slurry supply nozzle 20 for supplying slurry to a surface of the polishing pad 16, and a control unit 22 which controls the overall driving operations of the entire apparatus.

The disk-shaped platen 14 has a view hole 24 which is formed on its predetermined position and is formed to go through the platen 14. The view hole 24 has a transparent window 26 which is fitted into its top end opening.

The wafer holding head 18 presses the wafer W against the polishing pad 16 at a position which is away from the rotation center of the platen 14, and it is also driven and rotated horizontally by the motor (not shown). The wafer holding head 18 is driven also by an elevator (not shown) and is vertically moved up and down with respect to the polishing pad 16.

The wafer W being held with the wafer holding head 18 is pressed against the polishing pad 16 and the polishing pad 16 as well as the wafer W are rotated, then polishing starts while slurry is supplied from the slurry supply nozzle 20 to the polishing pad 16.

The polishing end point detecting device 12 mainly comprises an illumination/light receiving optical system 28, a branched light guide 30, a light source unit 32, a spectroscope (polychrometer) 34, and a computer 36.

The illumination/light receiving optical system 28 is supported to a bracket (not shown) and is located at a position under the view hole 24. The illumination/light receiving optical system 28 comprises a lens barrel 38 within which a condenser lens 40 is disposed.

The branched light guide 30 is a bundle of many optical fibers and is branched into two at one end. A light guide 30A of the branched side is connected to the light source unit 32 as the light guide 30A at an illuminating side, and a light guide 30B at the other side is connected to the spectroscope 34 as the light guide 30B at a light receiving side. Moreover, the combined end is connected to the illumination/light receiving optical system 28.

A lamp (e.g. a halogen lamp) which applies white light is built as into the light source unit 32 as a light source, and the white light from the light source is conducted to the illumination/light receiving optical system 28 by the light guide 30A at the illuminating side of the branched light guide 30. The white light having been outputted from the branched light guide 30 is then converged with a condenser lens 40 of the illumination/light receiving optical system 28, and is conducted through the window 26 formed on the platen 14 onto the polishing face (the bottom face) of the wafer W on the polishing pad 16 so as to illuminate the polishing face. After that, the light reflected on the polishing face is again converged with the condenser lens 40 of the illumination/light receiving optical system 28 and is led into the branched light guide 30, then is conducted to the spectroscope 34 through the light guide 30B at the light receiving side.

Figure 3:
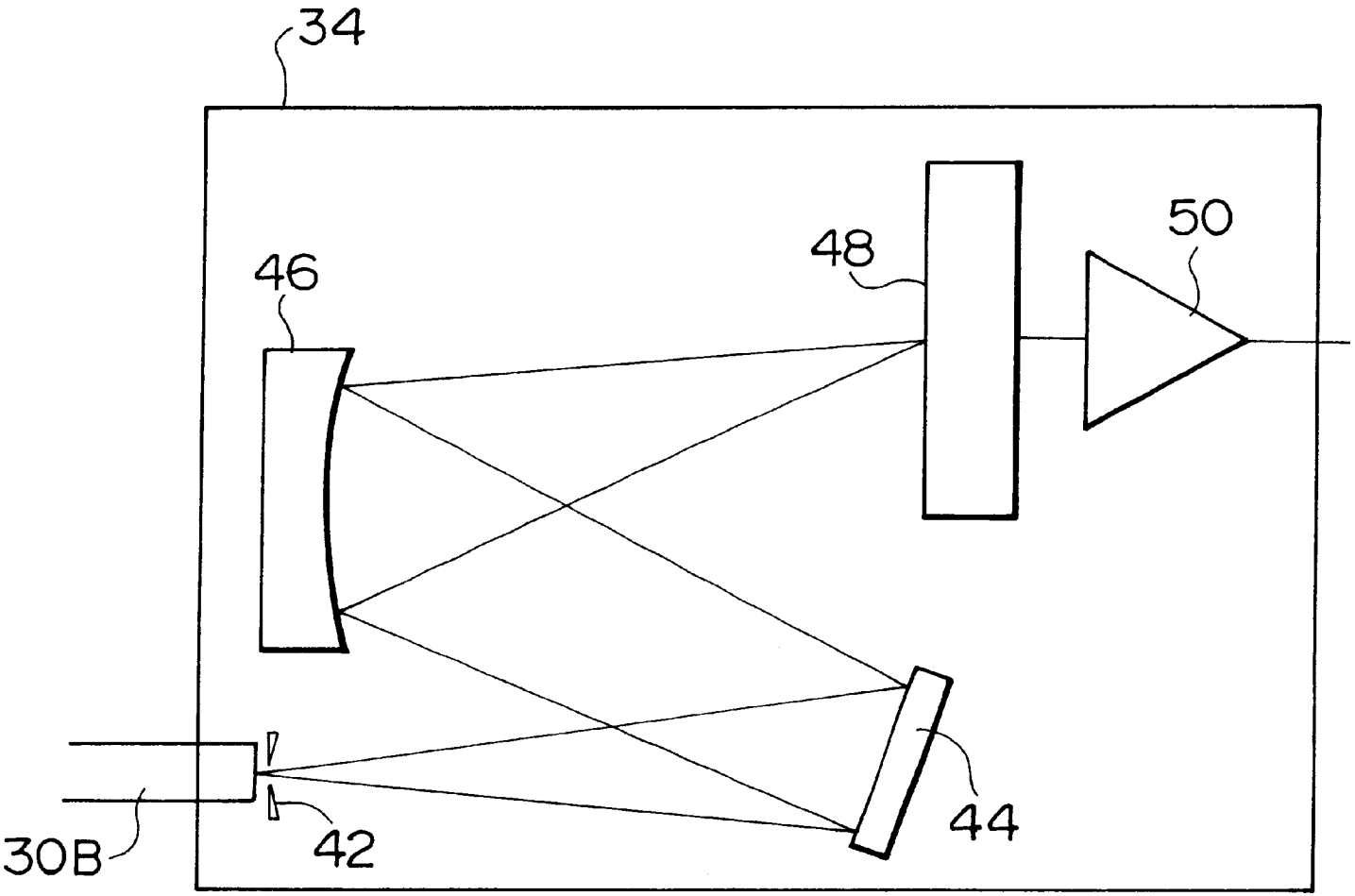
FIG. 3 is another block diagram showing a structure of a spectroscope (polychrometer)

The spectroscope 34 splits the reflected light having been conducted by the light guide 30B at the light receiving side into lights for corresponding wavelengths, and converts the split light into electric signals which correspond with intensities of corresponding wavelengths, then outputs the converted electric signals to the computer 36 as the light intensity signals for the wavelengths. As seen from FIG. 3, the spectroscope 34 comprises an incident slit 42, a plane mirror 44, a concave diffraction grating 46, an array light receiving device 48, and a multiplexer 50. The reflected light conducted to the spectroscope 34 by the light guide 30B at the light receiving side is further led through the incident slit 42 and conducted to the concave diffraction grating 46 by the plane mirror 44. Then, the light is split into lights for corresponding wavelengths by the concave diffraction grating 46, and forms an image on the array light receiving device 48. The light is now converted by the array light receiving device 48 into an electric signal which corresponds with light intensities for corresponding wavelengths, and is outputted to the computer 36 via the multiplexer 50 as the intensity signals for the wavelengths.

The computer 36 determines a polishing end point in accordance with the light intensity signals for the corresponding wavelengths of the reflected light which have been outputted from the spectroscope 34. More specifically, the computer 36 determines the polishing end point in accordance with a distribution of light intensities for the corresponding wavelengths of the reflected light (spectrum) which changes when the wafer W is polished and another type of film is exposed afterwards. When determining that the polishing comes to the end point in accordance with the result of the distribution, the computer 36 outputs a signal indicating the polishing end point to the control unit 22 of the wafer polishing apparatus 10, and completes the polishing process.

The computer 36 arithmetically processes the light intensity signals from the spectroscope 34 in accordance with the predetermined algorithm for detecting the polishing end point in order to determine a polishing end point for a specific film. In this process, the following algorithms are used: a main component scoring method, a color difference method, a hue difference method, and an area ratio method.

Main component scoring method: a spectrum of reflected light in a polishing process is measured beforehand, and a main component spectrum is obtained through a series of spectra, then the scores of the spectra are used as evaluation values. In a real time analysis of the polishing process, a score at each time is obtained, and a polishing end point is determined if a value of the score is the same or under or over the predetermined value, or if a value of the score is below or over the predetermined value.

First, a series of spectrum matrix R of the polishing process is resolved into a product of a main component spectrum matrix U and a score matrix Z, by using the main component analysis method:

$$m\overset{n}{\boldsymbol{R}} = m\overset{l}{\boldsymbol{U}} \times l\overset{n}{\boldsymbol{Z}}^{T} + m\overset{n}{\boldsymbol{E}}. \tag{1}$$

The first main component has the maximum information as to spectrum changes; thus a score of the first main component is determined as a evaluation value.

In order to obtain a score vector z from a spectrum r of the respective polishing processes, the following formula (2) is used, in which the first element of the score vector z becomes a score of the first main component:

$$ {}^{l}z^{T} = {}^{l}\overset{m}{U}^{T} \times {}^{m}\overset{1}{r}. \tag{2} $$

Color difference method: colors are numerically expressed by using a desired color stem from a spectrum of reflected light at a time of starting polishing, and the same color system is used for calculating a color difference or an index indicating the color difference from a spectrum of reflected light during polishing, then a polishing end point is determined if a value of the color difference is the same or over a predetermined value.

The following color systems may be used such as XYZ color system, Lab color system, L*a*b* color system, Luv color system, and L*u*v* color system. The following color differences may be used such as $\Delta E^*_{ab}$, $\Delta E^*_{uv}$, $\Delta E_H$ (Hunter's color difference), and $\Delta E_{AN}$ (Adams-Nickerson's color difference).

Simply, the color difference can be obtained by the following formulae (3) from $X_0$, $Y_0$, and $Z_0$ at a time of starting polishing and $X_i$, $Y_i$, and $Z_i$ during polishing:

$$ (X_i-X_0)^2+(Y_i-Y_0)^2+(Z_i-Z_0)^2, $$

or $$ \sqrt{(X_i - X_0)^2 + (Y_i - Y_0)^2 + (Z_i - Z_0)^2}\,. \tag{3} $$

Moreover, tristimuli X, Y, and Z of an object color by reflection can be obtained by a calculation which is defined in Japanese Industrial Standards (JIS) Z8721 "Colour specification—Specification according to their three attributes", which relates to "Munsell Book of Color (Macbeth a Division of Kollmorgen Corporation)".

L*, a*, b*, u*, and v* in the color systems L*a*b* and L*u*v* can be obtained from the tristimuli X, Y, and Z by a calculation which is defined in JIS Z8729 "Colour specification—CIE LAB and CIE LUV colour spaces", which corresponds to Publication CIE No. 15. 2 (1986) Colorimetry, Second Edition, 4, and relates to ISO 7724-1 and ISO 7724-3. Further, $\Delta E^*_{ab}$, $\Delta E^*_{uv}$, $\Delta E_H$, and $\Delta E_{AN}$ can be obtained from values of the respective color systems at the time of starting polishing and values of the respective color systems at the respective times during polishing by a calculation defined in JIS Z8730 "Colour specification—Colour differences of non-luminous object colour", which corresponds to Publication CIE No. 15. 2 (1986) Colorimetry, Second Edition, 4, and relates to ISO 7724-1 and ISO 7724-3.

Hue difference method: colors are numerically expressed by using a desired color system from a spectrum of reflected light at the time of starting polishing, and the same color system is used for calculating a hue or an index indicating the hue at the time of starting polishing from a spectrum of reflected light during polishing, then a polishing end point is determined if a value of the hue difference is the same or over a predetermined value.

The following color systems may be used such as XYZ color system, Lab color system, L*a*b* color system, Luv color system, and L*u*v* color system; as color differences, ΔH*ab (Δhab), ΔH*uv (Δhuv), and so forth, may be used.

Simply, the color difference can be obtained by following formulae (4) and (5) from $X_0$, $Y_0$, and $Z_0$ at the time the polishing starts, and $X_i$, $Y_i$, and $Z_i$ during polishing:

$$ (x_i - x_0)^2 + (y_i - y_0)^2, \quad \text{or} \quad \sqrt{(x_i - x_0)^2 + (y_i - y_0)^2}\,; \tag{4} $$

$$ x = \frac{X}{X+Y+Z}, \quad y = \frac{Y}{X+Y+Z}, \tag{5} $$

where X, Y, and Z indicate tristimuli of the object color.

L*, a*, b*, u*, and v* in the color systems L*a*b* and L*u*v* can be obtained by a calculation defined in "JIS Z8729" from the tristimuli. Moreover, ΔH*ab (Δhab) and ΔH*uv (Δhuv) can be obtained by a calculation defined in "JIS Z8730" from values of the respective color systems at the time of starting polishing and values of the respective color systems at the respective times during polishing.

Area ratio method: two areas of wavelengths are selected with which reflect characteristics dramatically changes between a spectrum of the reflected light at the time of starting polishing and a spectrum of the reflected light at the polishing end point, and area ratio between the two areas of wavelengths is calculated as an index. If the value is larger at the polishing end point, a value which is the same or over a predetermined value is determined as a polishing end point. If the value is smaller at the polishing end point, a value which is the same or under the predetermined value is determined as a polishing end point.

The computer 36 follows the above-described algorithms in order to arithmetically process the light intensity signal from the spectroscope 34 and determines a polishing end point for the specific film.

Now, an operation of the polishing end point detecting device 12 for the wafer polishing apparatus 10 in the present embodiment which has been constructed as described above will be presented.

When lighting up the light source (not shown) of the light source unit 32, the white light from the light source is conducted into the light guide 30A at the illuminating side of the branched light guide 30, and further conducted into the illumination/light receiving optical system 28. The white light having been conducted into the illumination/light receiving optical system 28 is converged with the condenser lens 40, and is conducted now through the window 26 which is formed on the platen 14 of the wafer polishing apparatus 10 in such a manner to illuminate the polishing face (bottom face) of the wafer W being polished.

The light having been reflected on the polishing face of the wafer W is conducted through the window 26 and reaches at the condenser lens 40 of the illumination/light receiving optical system 28. After being converged with the condenser lens 40, the reflected light is conducted into the branched light guide 30. The reflected light having been conducted into the branched light guide 30 is now conducted into the spectroscope 34 by the branched light guide 30B at the light receiving side.

The reflected light having been conducted now into the spectroscope 34 is further led through the incident slit 42 and conducted into the concave diffraction grating 46 with the plane mirror 44, and is split into lights for corresponding wavelengths at the concave diffraction grating 46, then forms an image on the array light receiving device 48. The light forming the image on the array light receiving device 48 is converted into electric signals corresponding with the corresponding wavelengths via the array light receiving device 48, and is outputted to the computer 36 as the light intensity signal for the wavelengths via the multiplexer 50.

The computer 36 arithmetically processes the light intensity signal for corresponding wavelengths of the reflected light in accordance with the predetermined algorithm for detecting a polishing end point in order to determine the polishing end point for the specific film. Then, the computer 36 outputs a signal indicating a polishing end point to the control unit 22 of the wafer polishing apparatus 10, and completes the polishing process.

According to the polishing end point detecting device 12 for the wafer polishing apparatus 10 in the present embodiment, the reflected light having been picked up is split into lights for the corresponding wavelengths, and the polishing end point is determined in accordance with the light intensity distribution of the wavelengths which has been split. Thus, the color components of the reflected light can be precisely analyzed and the polishing end point can be accurately detected.

Moreover, since the illumination light is conducted and the reflected light is picked up by respectively using the light guide 30A at the illuminating side and the light guide 30B at the light receiving side, the light can be more efficiently used as compared with a conventional case using a beam splitter. Detection sensitivity thereby improves and detection ability can effectively be prevented from being lowered due to a displaced optical alignment.

Figure 4:
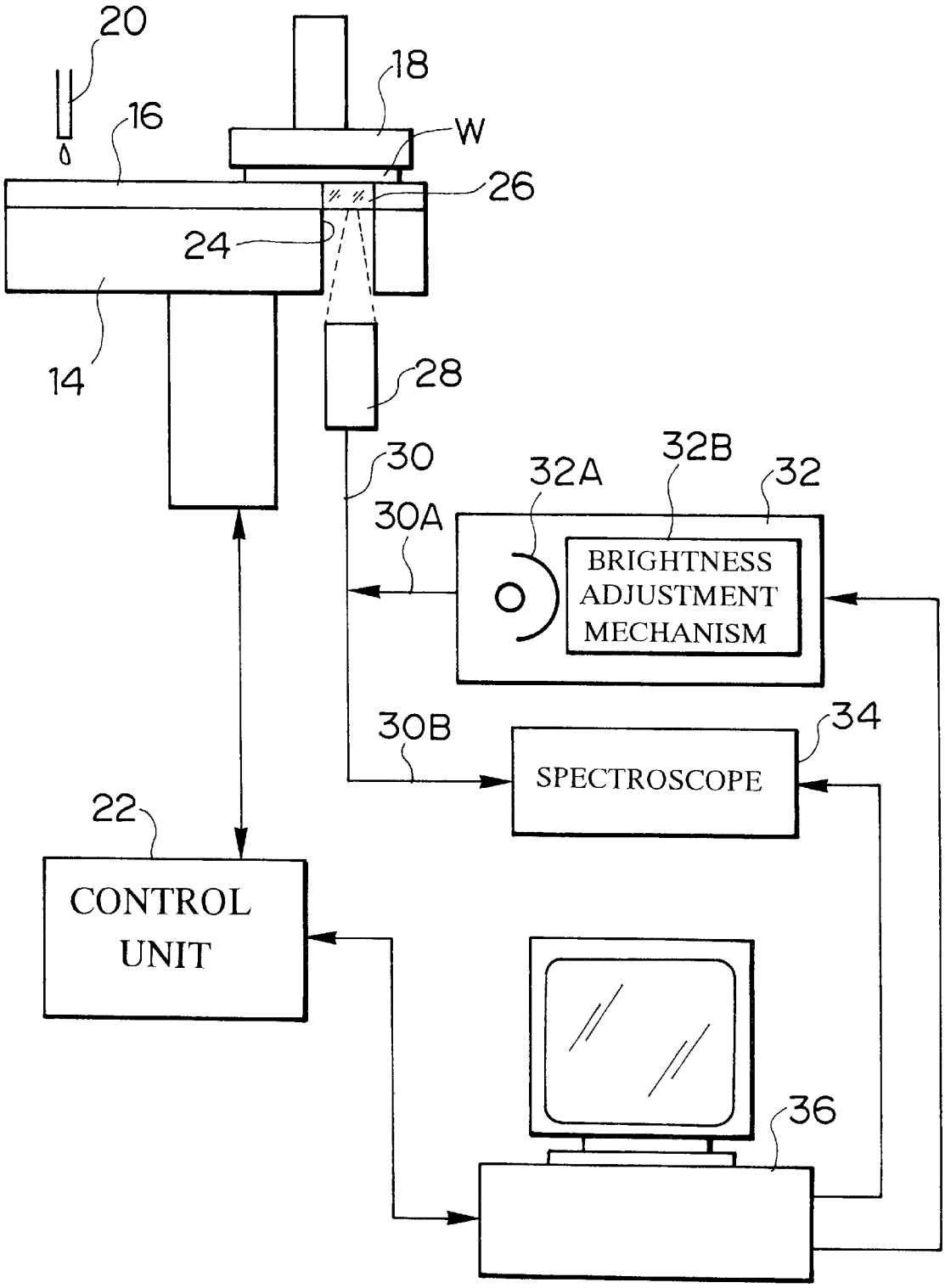
FIG. 4 is still another block diagram showing a structure of the polishing end point detecting device for the wafer polishing apparatus in a second embodiment of the present invention.

FIG. 4 is a block diagram showing a structure of the polishing end point detecting device for the wafer polishing apparatus in a second embodiment of the present invention.

As seen from FIG. 4, the polishing end point detecting device 12 in the second embodiment has a brightness adjustment mechanism 32B which is built in the light source unit 32 for adjusting brightness of the light source lamp 32A of the light source unit 32. The brightness adjustment mechanism 32B adjusts brightness of the light source lamp 32A in accordance with a control signal which is outputted from the computer 36. Adjustment of the brightness of the light source lamp 32A is achieved by, for example, adjusting an amount of electricity which is supplied to the light source lamp 32A.

Moreover, the computer 36 of the polishing end point detecting device 12 in the present embodiment arithmetically processes a light intensity signal from the spectroscope 34 in accordance with an algorithm for detecting a predetermined polishing end point in order to detect a polishing end point for a specific film. The computer 36 outputs a polishing end point signal to the control unit 22 of the wafer polishing apparatus 10 when detecting the polishing end point, and terminates the polishing process.

Description to other structure of the polishing end point detecting device is omitted since the structure is exactly the same as that of the polishing end point detecting device in the first embodiment.

An operation for the polishing end point detecting device 12 in the second embodiment will hereunder be described.

In the polishing end point detecting device 12 in the present embodiment, white light is applied onto a polishing face of the wafer W and the light intensity spectrum of the reflected light is measured so as to detect a polishing end point. First, a method for measuring the light intensity spectrum will be described.

When turning on the light source lamp 32A of the light source unit 32, white light of the light source lamp 32A enters into the light guide 30A at the illuminating side of the branched light guide 30, and the white light is conducted into the illumination/light receiving optical system 28. After the light is condensed by the illumination/light receiving optical system 28, the light is applied onto the polishing face of the wafer W being polished through the observation window 26 which is formed on the platen 14 of the wafer polishing apparatus 10.

The light which has been reflected on the polishing face of the wafer W now goes through the observation window 26 and is condensed by the illumination/light receiving optical system 28, and is conducted into the branched light guide 30. After that, the light is led into the spectroscope 34 by the light guide 30B at the light receiving side.

The reflected light being conducted into the spectroscope 34 is divided into lights for the respective wavelength by the spectroscope 34, and is converted into electric signals corresponding with the light intensities for the respective wavelengths, then is outputted to the computer 36 as the light intensity signals (light intensity spectrum) for the respective wavelengths.

The computer 36 arithmetically processes the light intensity signal (light intensity spectrum) for the respective wavelengths of the reflected light in accordance with the algorithm for detecting the predetermined polishing end point, whereby the polishing end point for the specific film is detected. More specifically, the computer 36 arithmetically calculates a ratio between a light intensity spectrum of the reflected light which has been obtained from the spectroscope 34 and a light intensity spectrum of the reflected light which has been obtained from a reference sample and has been stored in a memory, and the computer 36 detects the polishing end point by referring to the ratio as the data of the measured reflection rate. For example, the polishing end point is detected by referring to a variation of color coordinates which is based on the data of the measured reflection rate.

In this method, a light intensity spectrum of the reference sample (e.g. an aluminum plate) is measured before starting another polishing after exchanging the polishing pad 16, and the light intensity spectrum of the reference sample is stored in the memory which is built in the computer 36. The measuring of the spectrum of the reflected light from the reference sample is performed by placing the reference sample on the observation window 26 of the polishing pad 16.

The light to be applied onto the polishing face of the wafer W is applied through the observation window 26; thus a light intensity spectrum of the wafer W which is measured by the spectroscope 34 is affected by the observation window 26 and the optical system itself. Those affects by the observation window 26 and the optical system itself deteriorates detection for the polishing end point as darkness components (i.e. noise components).

For that reason, the computer 36 detects the polishing end point after eliminating the darkness components with respect to the light intensity of the wafer W which has been measured by the spectroscope 34. In short, the computer 36 determines the light intensity as a true light intensity spectrum which is obtained by subtracting the darkness components from the light intensity spectrum of a wafer having been detected, and the computer 36 uses the true light intensity for detecting the polishing end point. Since the darkness components are included in the light intensity spectrum of the reference sample, the polishing end point is detected in the same manner after eliminating the darkness components. That is, the computer 36 determines the light intensity as the true light intensity which is obtained by subtracting the darkness components from the light intensity spectrum of the reference sample having been measured, and the computer 36 uses the true light intensity for detecting the polishing end point.

In the measurement of the darkness components, the light enters into the observation window 26 while nothing is placed on the observation window 26 of the polishing pad 16, and the light intensity spectrum of the reflected light is measured. The measured darkness is stored into the memory which is built in the computer 36.

As described above, in the polishing end point detecting device 12 in the present embodiment, the light is applied onto the polishing face of the wafer W, and light intensity spectrum of the reflected light is measured, then the polishing end point is detected based on the ratio (measured reflection rate) between the light intensity spectrum of the reflected light and the light intensity spectrum of the reflected light of the reference sample.

In the polishing end point detecting device 12 in the present embodiment, the light is applied onto the polishing face of the wafer W through the observation window 26, which though changes transmittance due to change of processing conditions and an environment of the wafer W. If the transmittance changes, an amount of the reflected light to be entered into the spectroscope 36 changes, and the polishing end point cannot be accurately detected.

In order to solve this problem, the polishing end point detecting device 12 in the present embodiment automatically adjusts brightness of the light source so that an amount of the light to be entered into the spectroscope 36 is maintained constant even though the condition of the observation window 26 changes. Moreover, the polishing end point detecting device 12 automatically corrects the light intensity spectrum of the reference sample due to changes of the brightness of the light source.

Figure 5:
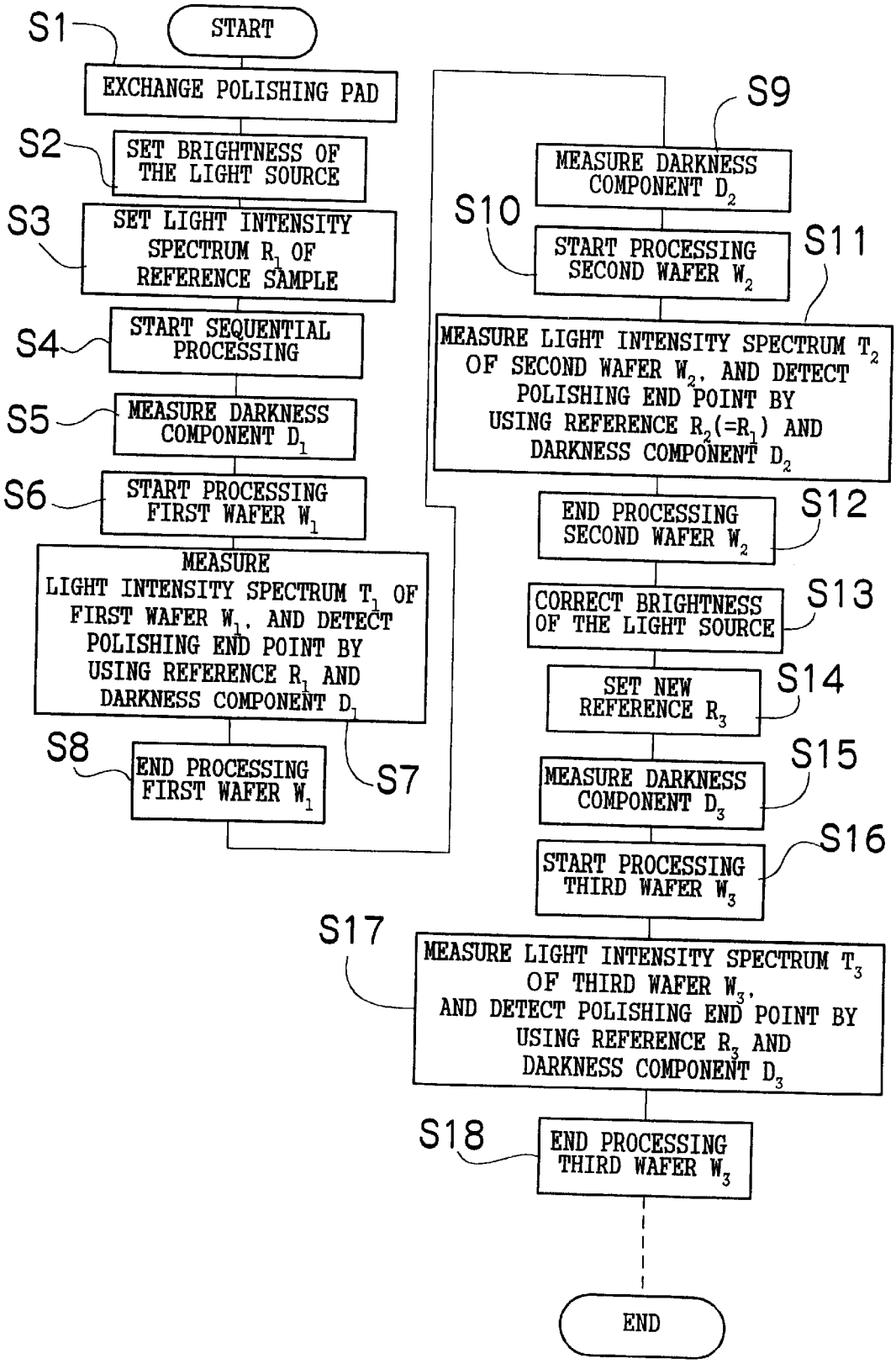
FIG. 5 is a flowchart showing a procedure for processing wafers by using the polishing end point detecting method of the present invention.

Hereunder a method will be described for processing the wafer W in combination with the method for adjusting the brightness of the light source (refer to FIG. 5).

First, when exchanging the polishing pad 16 (Step 1), the brightness of the light source is set under the new polishing pad 16 (Step S2). The brightness of the light source at that time is $L_1$.

After the brightness of the light source is set, the computer 36 measures the light intensity spectrum of the reference sample under the set brightness $L_1$. Then, the obtained light intensity spectrum is set at a reference light intensity spectrum $R_1$ and is stored in the memory (Step S3).

The initial setting is completed by the above-described process; a sequential wafer processing then starts (Step S4).

When the sequential wafer processing starts, the darkness components are measured (Step S5). As mentioned above, a measurement of the darkness components is performed by applying the white light into the observation window 26 in a state where nothing is placed on the observation window 26 of the polishing pad 16, and a light intensity spectrum of the reflected light is measured. The measured darkness $D_1$ is stored in the memory which is built in the computer 36.

Next, a first wafer $W_1$ is placed on the polishing pad 16, and processing the wafer $W_1$ starts (Step S6), and at the same time a light intensity spectrum $T_1$ of the first wafer $W_1$ is measured.

The computer 36 detects the polishing end point based on the measured light intensity spectrum $T_1$, a light intensity spectrum $R_1$ of the reference sample, and the darkness component $D_1$ that are stored in the memory (Step S7). More specifically, the darkness component $D_1$ is subtracted from the measured light intensity spectrum $T_1$ and the light intensity spectrum $R_1$ of the reference sample in order to eliminate the darkness component, and the a measurement reflection rate $V_1$ is obtained from the light intensity spectrum $T_1$ of the wafer $W_1$ and the light intensity spectrum $R_1$ of the reference sample after eliminating the darkness component, then the polishing end point is detected based on the measured reflection rate $V_1$. After the polishing end point is detected, the computer 36 outputs a polishing end point signal to the control unit 22, and completes the polishing.

The light intensity spectrum $T_1$ of the wafer $W_1$ is measured at every rotation of the polishing pad 16, and the measured light intensity spectrum is stored in the memory of the computer 36 as measurement data.

After the polishing, the first wafer $W_1$ is taken away from the polishing pad 16, and a darkness component is measured again; this time the measured darkness component is $D_2$ (Step S9). After the darkness component $D_2$ is measured, a second wafer $W_2$ is set on the polishing pad 16, and another polishing starts (Step S10), and at the same time the polishing end point is detected (Step S11).

At this point, the polishing end point for the second wafer $W_2$ is detected without changing the brightness of the light source ($L_2$=$L_1$), and by using the light intensity spectrum ($R_2$=$R_1$) of the reference sample which is the same as that with the first wafer $W_1$. Moreover, the darkness component $D_2$ is used which has been measured before starting the polishing of the second wafer $W_2$.

Figure 6:
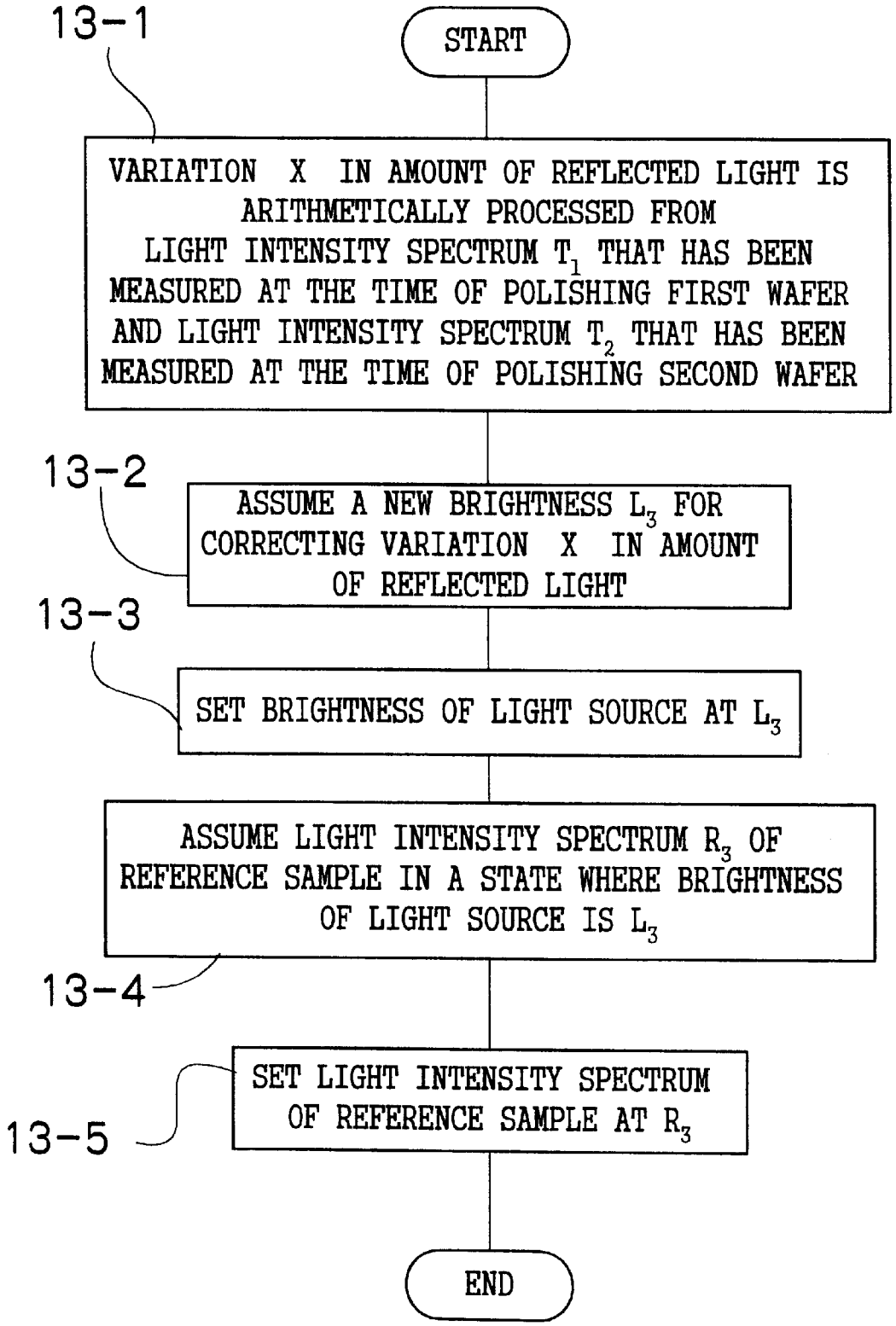
FIG. 6 is a flowchart showing a procedure of a method for correcting brightness of a light source.

When the polishing end point for the second wafer $W_2$ is detected and the polishing is completed, the second wafer $W_2$ is taken away from the polishing pad 16 (Step S12) After processing the second wafer $W_2$", the computer 36 corrects the brightness of the light source in accordance with a flowchart shown in FIG. 6 (Step S13).

First, the computer 36 obtains a variation X in an amount of the reflected light, that is, the light which enters into the spectroscope 38, from the light intensity spectrum $T_1$ which has been measured at the time of polishing the first wafer $W_1$ and the light intensity spectrum $T_2$ which has been measured at the time of polishing the second wafer $W_2$ (Step S13-1).

In this state, since the light intensity spectrum $T_1$ which has been measured at the time of polishing the first wafer $W_1$ and the light intensity spectrum $T_2$ which has been measured at the time of polishing the second wafer $W_2$ are stored in the memory as the measurement data in the manner described above, the variation X in an amount of the reflected light is obtained by using the measurement data.

The light intensity spectrum at that time has been measured plural times from the start of polishing to the detection of the polishing end point; thus the variation X in the amount of the reflected light is obtained by using the light intensity spectra in a range of measurement times that has been designated beforehand among the light intensity spectra that have been measured plural times.

Then, a brightness $L_3$ of the light source is assumed from the obtained variation X in an amount of light of the reflected light in order to eliminate the variation of the amount of light (Step S13-2). After that the brightness $L_3$ of the light source which is assumed is set as a new brightness of the light source (Step S13-3).

In this process, the computer 36 stores in its memory an amount of light for correcting the brightness L of the light source based on the variation X in the amount of light, and the new brightness $L_3$ of the light source is obtained based on the data indicating a relationship between the variation X of the amount of light and the brightness L of the light source.

When the new brightness $L_3$ of the light source is set, the computer 36 outputs a control signal to the brightness adjustment mechanism 32B of the light source unit 32, and adjusts the brightness so that the brightness of the light source 32A is set at the new brightness $L_3$.

On the other hand, the light intensity spectrum of the reference sample changes due to changes in the brightness of the light source; thus the light intensity spectrum $R_2$ of the reference sample which has been measured at the time of polishing the second wafer $W_2$ (this also means the light intensity spectrum $R_1$ of the reference sample which has been measured at the time of polishing the first wafer $W_1$ is corrected based on the newly set brightness $L_3$ of the light source (Step S13-4).

The computer 36 stores in its memory as data an amount of correction of the light intensity spectrum R of the reference sample that is based on the changes in the brightness of the light source; thus the light intensity spectrum $R_2$ of the reference sample which has been measured at the time of polishing the second wafer $W_2$ (this also means the light intensity spectrum $R_1$ of the reference sample which has been measured at the time of polishing the first wafer W1) is corrected based on the data indicating a relationship between the brightness variation X and an amount to be corrected. After that, the new light intensity spectrum $R_3$ of the reference sample that has been corrected is set at a light intensity spectrum of the reference sample for polishing of a third wafer (Steps S13-5 and S14).

Brightness of the light source and the light intensity spectrum of the reference sample are thereby corrected. As those corrections are completed, a darkness component $D_3$ is measured (Step S15), and subsequently the third wafer $W_3$ is set on the polishing pad 16, then the polishing starts (Step S16); at the same time the polishing end point is detected (Step S17).

At this point, the polishing end point for the third wafer $W_3$ is detected by using a light intensity spectrum $R_3$ of the reference sample that has been set under the newly set brightness $L_3$ and the darkness component $D_3$ that has been measured before starting the polishing of the third wafer $W_3$.

When the polishing end point for the third wafer $W_3$ is detected and the polishing is completed, the third wafer W3 is taken away from the polishing pad 16 (Step S18). After the completion of processing the third wafer $W_3$, the computer 36 corrects again the brightness of the light source in the same manner which is described above.

Specifically, first, the variation X in the amount of the reflected light is obtained from the light intensity spectrum $T_2$ that has been measured at the time of polishing the second wafer $W_2$ and the light intensity spectrum $T_3$ that has been measured at the time of polishing the third wafer $W_3$. A brightness $L_4$ of the light source to be set which eliminates the variation X is obtained.

When the new brightness $L_4$ is obtained, the computer 36 outputs a control signal to the brightness adjustment mechanism 32B of the light source unit 32, and adjusts the brightness of the light source lamp 32A to be at the brightness $L_4$.

On the other hand, since the light intensity spectrum of the reference sample changes due to changes of the brightness of the light source, the light intensity spectrum $R_3$ of the reference sample which has been measured at the time of polishing the third wafer is corrected based on the newly set brightness $L_4$ of the light source. Then the corrected light intensity spectrum of the reference sample is set at a light intensity spectrum $R_4$ of the reference sample to be used in polishing of a fourth wafer.

The wafers are sequentially processed afterwards in the same manner that the brightness of the light source and the light intensity spectrum of the reference sample are corrected at processing each wafer.

In other words, when processing of the wafer $W_n$ is completed, the computer 36 obtains the variation X in the amount of the reflected light from the light intensity $T_{n-1}$ of the wafer $W_{n-1}$ that has been processed the last time and the light intensity $T_n$ of the wafer $W_n$ that is polished at a present time. The computer 36 then obtains the brightness L of the light source which eliminates the variation X in the amount of light, and sets the new brightness as the brightness L of the light source.

On the other hand, since the light intensity spectrum of the reference sample changes due to changes of the brightness of the light source, the light intensity spectrum $R_n$ of the reference sample at the time of polishing is corrected based on the newly set brightness of the light source, and the newly set light intensity spectrum of the reference sample is set as the light intensity spectrum $R_{n+1}$ of the reference sample for polishing the next wafer $W_{n+1}$.

As described above, according to the polishing end point detecting method in the second embodiment, the brightness of the light source and the light intensity spectrum of the reference sample are corrected at every time a wafer is processed. Therefore, an amount of light to enter (reflected light) into the spectroscope 38 is maintained constant even though a condition of the observation window 26 changes, and the polishing end point can be always detected accurately.

In the present embodiment, the brightness of the light source lamp 32A is adjusted by adjusting an amount of electricity to be supplied to the light source lamp 32A; however, the brightness may be adjusted by other methods as well.

Figure 7:
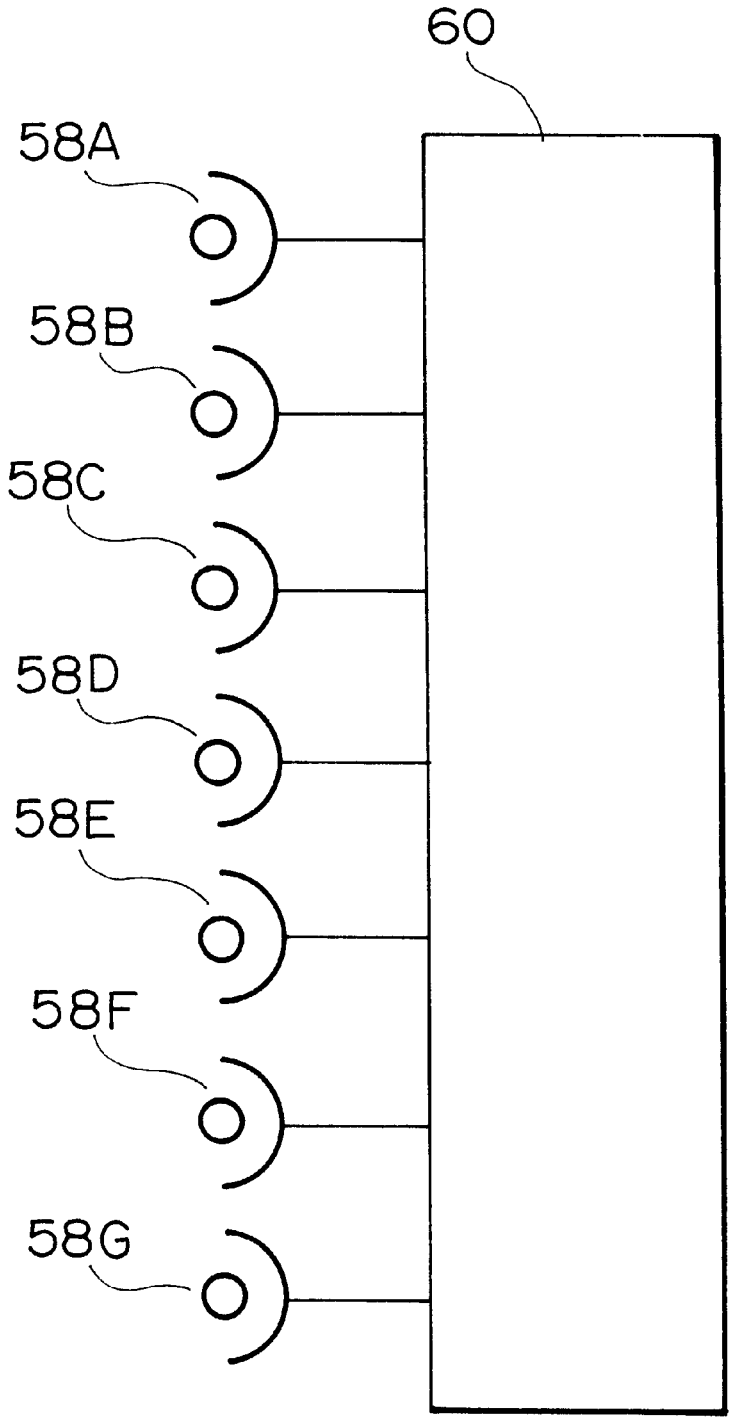
FIG. 7 is a view showing a structure of a brightness adjustment mechanism in another embodiment.

For example, as seen from FIG. 7, plural light source lamps 58A–58G with different brightnesses are provided, and one of the light source lamps is selectively lighted with a switch 60 so as to adjust the brightness.

Figure 8:
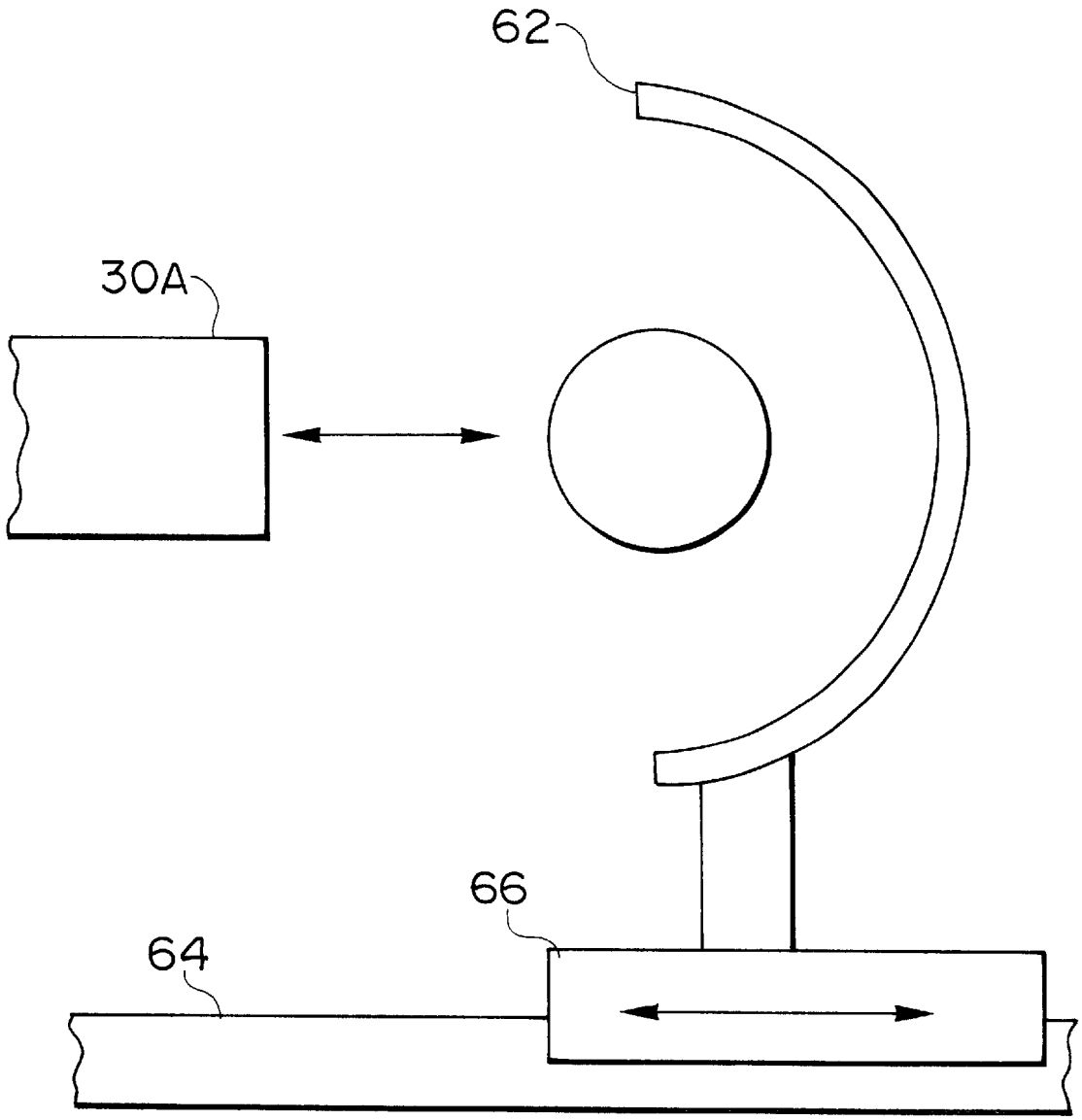
FIG. 8 is a view showing a structure of a brightness adjustment mechanism in still another embodiment.

Moreover, as seen from FIG. 8, a light source lamp 62 is mounted on a slide block 66 which slides on a guide rail 64, and the light source lamp 62 is moved back and forth with respect to the light guide 30A at the illuminating side, thereby a length of an optical path from the light source 62 to the observation window 26 is changed and the brightness of the light source is adjusted.

Figure 9:
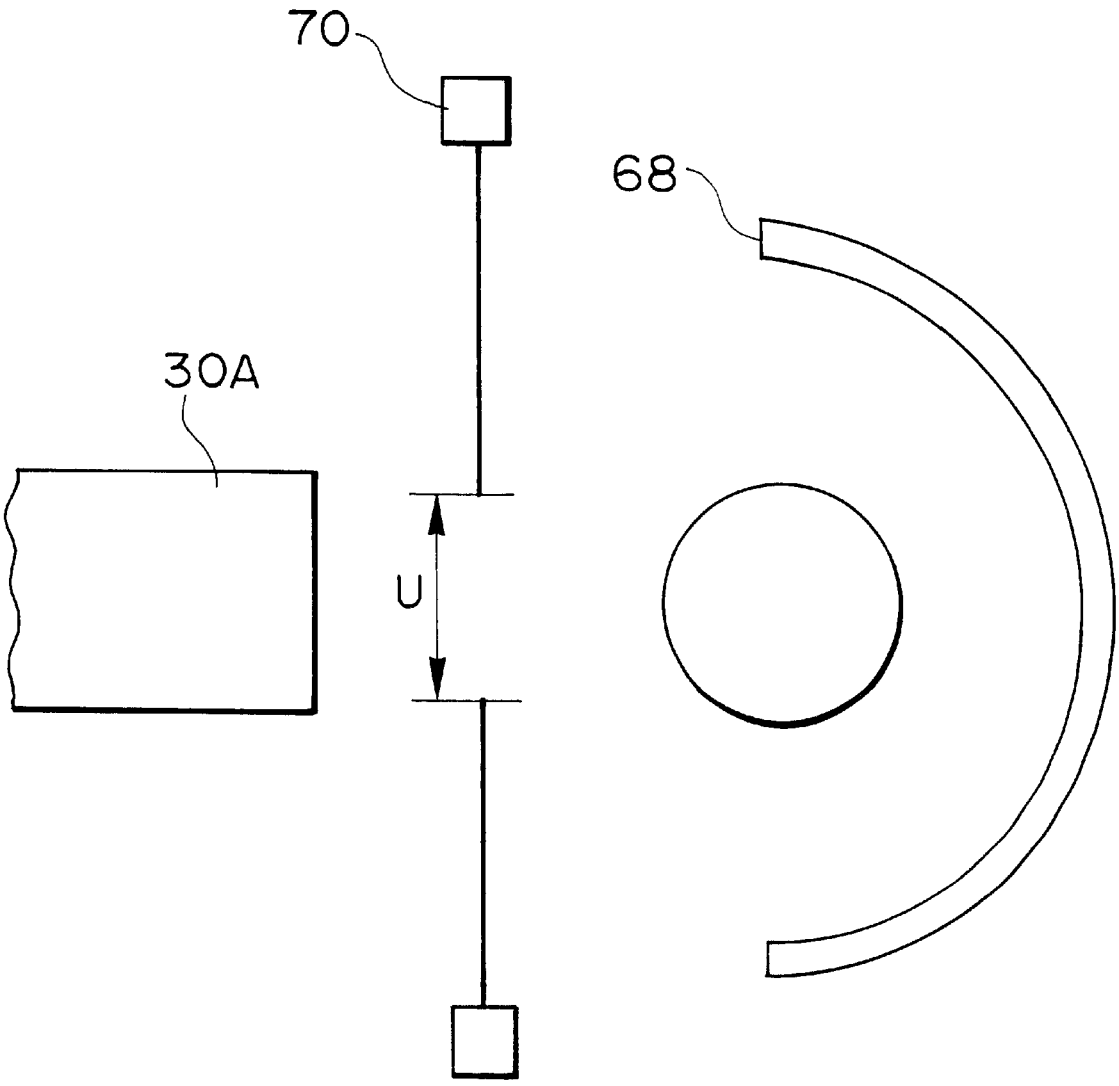
FIG. 9 is a view showing a structure of a brightness adjustment mechanism in yet another embodiment.

Further, as seen from FIG. 9, a stop 70 is provided in front of a light source lamp 68, and the brightness of the light source is adjusted by changing an amount of an opening U of the stop 70.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A polishing end point detecting device for a wafer polishing apparatus, the polishing end point detecting device comprising:

a light source;

a light guide at an illuminating side which conducts light outputted from said light source onto a polishing face of a wafer so as to illuminate the polishing face;

a light guide at a light receiving side which conducts the light being reflected on the polishing face of said wafer after having been conducted from said light guide at the illuminating side onto the polishing face of said wafer;

a spectroscope which splits the light conducted by said light guide at the light receiving side into lights for corresponding wavelengths;

a photoelectric converting device which converts the light having been split by said spectroscope into electric signals corresponding with a light intensity of each of the wavelengths, and outputs the converted lights as light intensity signals for the corresponding wavelengths; and an end point determination device which determines a polishing end point in accordance with the light intensity signals for the corresponding wavelengths that have been outputted from said photoelectric converting device;

wherein one end of said light guide at the illuminating side and one end of said light guide at the light receiving side are combined.

2. A polishing end point method for a wafer polishing apparatus, in which a wafer is pressed against a polishing pad and the wafer is polished by sliding the wafer and the polishing pad relative to each other while supplying slurry, the method comprising the steps of:

applying white light from a light source onto the wafer which is being polished through a window formed on the polishing pad; and performing spectrometric analysis of light that is reflected on the wafer, so that the polishing end point of the wafer is detected;

wherein an amount of said reflected light is measured, and brightness of said light source is corrected so that the amount of the reflected light is constant.

3. The polishing end point detecting method as defined in claim 2, wherein the brightness of said light source is corrected by changing an amount of electricity to be supplied to said light source.

4. The polishing end point detecting method as defined in claim 2, wherein the brightness of said light source is corrected through the following steps:

providing plural light sources with different brightnesses; and selecting one of said light sources to light up.

5. The polishing end point detecting method of defined in claim 2, wherein the brightness of said light source is corrected by changing a length of an optical path from said light source to said window.

6. The polishing end point detecting method as defined in claim 2, wherein:

the white light is applied onto the wafer through a stop; and the brightness of said light source is corrected by changing an amount of opening of the stop.

7. The polishing end point detecting method as defined in claim 2, wherein the light intensity spectrum of the reflected light from the reference sample is corrected in accordance with the brightness of the light source that has been corrected.

8. The polishing end point detecting method as defined in claim 7, wherein the brightness of said light source is corrected by changing an amount of electricity to be supplied to said light source.

9. The polishing end point detecting method as defined in claim 7, wherein the brightness of said light source is corrected through the following steps:

providing plural light sources with different brightnesses; and selecting one of said light sources to light up.

10. The polishing end point detecting method as defined in claim 7, wherein the brightness of said light source is corrected by changing a length of an optical path from said light source to said window.

11. The polishing end point detecting method as defined in claim 7, wherein:

the white light is applied onto the wafer through a stop; and the brightness of said light source is corrected by changing an amount of opening of the stop.

12. A polishing end point detecting method for a wafer polishing apparatus, in which a wafer is pressed against a polishing pad and the wafer is polished by sliding the wafer and the polishing pad each other while supplying slurry, the method comprising the steps of:

applying white light from a light source onto the wafer which is being polished through a window formed on the polishing pad; and performing spectrometric analysis of light that is reflected on the wafer, so that the polishing end point of the wafer is detected;

wherein said spectrometric analysis comprises the following steps:

measuring a light intensity spectrum of said reflected light;

obtaining a ratio between the light intensity spectrum of said reflected light and a light intensity spectrum of the reflected light of a reference sample which has been obtained beforehand; and detecting the polishing end point based on the obtained ratio.

13. The polishing end point detecting method as defined in claim 12, wherein an amount of said reflected light is measured, and brightness of said light source is corrected so that the amount of the reflected light is constant.

14. The polishing end point detecting method as defined in claim 13, wherein the brightness of said light source is corrected by changing an amount of electricity to be supplied to said light source.

15. The polishing end point detecting method as defined in claim 13, wherein the brightness of said light source is corrected through the following steps:

providing plural light sources with different brightnesses; and selecting one of said light sources to light up.

16. The polishing end point detecting method as defined in claim 13, wherein the brightness of said light source is corrected by changing a length of an optical path from said light source to said window.

17. The polishing end point detecting method as defined in claim 13, wherein:

the white light is applied onto the wafer through a stop; and the brightness of said light source is corrected by changing an amount of opening of the stop.

18. The polishing end point detecting method as defined in claim 13, wherein the light intensity spectrum of the reflected light from the reference sample is corrected in accordance with the brightness of the light source that has been corrected.

19. The polishing end point detecting method as defined in claim 18, wherein the brightness of said light source is corrected by changing an amount of electricity to be supplied to said light source.

20. The polishing end point detecting method as defined in claim 18, wherein the brightness of said light source is corrected through the following steps:

providing plural light sources with different brightnesses; and selecting one of said light sources to light up.

21. The polishing end point detecting method as defined in claim 18, wherein the brightness of said light source is corrected by changing a length of an optical path from said light source to said window.

22. The polishing end point detecting method as defined in claim 18, wherein:

the white light is applied onto the wafer through a stop; and the brightness of said light source is corrected by changing an amount of opening of the stop.

23. A polishing end point detecting device for a wafer polishing apparatus in which a wafer is pressed against a polishing pad and the wafer is polished by sliding the wafer and the polishing pad relative to each other while supplying slurry, the polishing end point detecting device comprising:

a window which is formed on said polishing pad;

a light source which applies white light onto the wafer being polished through said window;

an end point detecting device which detects a polishing end point of said wafer by performing a spectrometric analysis to a reflected light of said white light which has been reflected on the polishing face of said wafer;

a light amount measuring device which measures an amount of said reflected light;

a brightness adjusting device which adjusts brightness of said light source;

an arithmetic unit which obtains the brightness of said light source so that the amount of the reflected light which has been measured by said light amount measuring device is constant; and a control unit which corrects the brightness of said light source by controlling said brightness adjusting device so that the brightness is set at the brightness that is obtained by said arithmetic unit.

24. The polishing end point detecting device as defined in claim 23, wherein said brightness adjustment device adjusts the brightness by changing an amount of electricity to be supplied to said light source.

25. The polishing end point detecting device as defined in claim 23, wherein said brightness adjustment device is provided with a plurality of light sources with different brightnesses and adjusts the brightness by selecting one of the plurality of the light sources to light up.

26. The polishing end point detecting device as defined in claim 23, wherein said brightness adjustment device adjusts the brightness by changing a length of an optical path from said light source to said window.

27. The polishing end point detecting device as defined in claim 23, wherein said brightness adjustment device conducts the white light which has been outputted from said light source through a stop, and adjusts the brightness by changing an amount of opening of the stop.

28. The polishing end point detecting device as defined in claim 23, further comprising a reference correcting device for correcting the light intensity spectrum of the reflected light from the reference sample based on the corrected brightness of the light source.

29. The polishing end point detecting device as defined in claim 28, wherein said brightness adjustment device adjusts the brightness by changing an amount of electricity to be supplied to said light source.

30. The polishing end point detecting device as defined in claim 28, wherein said brightness adjustment device is provided with a plurality of light sources with different brightnesses and adjusts the brightness by selecting one of the plurality of the light sources to light up.

31. The polishing end point detecting device as defined in claim 28, wherein said brightness adjustment device adjusts the brightness by changing a length of an optical path from said light source to said window.

32. The polishing end point detecting device as defined in claim 28, wherein said brightness adjustment device conducts the white light which has been outputted from said light source through a stop, and adjusts the brightness by changing an amount of opening of the stop.

33. A polishing end point detecting device for a wafer polishing apparatus in which a wafer is pressed against a polishing pad and the wafer is polished by sliding the wafer and the polishing pad relative to each other while supplying slurry, the polishing end point detecting device comprising:

a window which is formed on said polishing pad;

a light source which applies white light onto the wafer being polished through said window;

an end point detecting device which detects a polishing end point of said wafer by performing a spectrometric analysis to a reflected light of said white light which has been reflected on the polishing face of said wafer;

a measuring device which measures a light intensity spectrum of said reflected light;

a storage unit in which a light intensity spectrum of reflected light from a reference sample having been obtained beforehand is stored; and a determination device which determines a polishing end point based on a ratio, the ratio being obtained between the light intensity spectrum of said reflected light which has been measured by said measuring device and the light intensity spectrum of the reflected light from said reference sample which is stored in said storage device.

34. The polishing end point detecting device as defined in claim 33, further comprising:

a light amount measuring device which measures an amount of said reflected light;

a brightness adjusting device which adjusts brightness of said light source;

an arithmetic unit which obtains the brightness of said light source so that the amount of the reflected light which has been measured by said light amount measuring device is constant; and a control unit which corrects the brightness of said light source by controlling said brightness adjusting device so that the brightness is set at the brightness that is obtained by said arithmetic unit.

35. The polishing end point detecting device as defined in claim 34, wherein said brightness adjustment device adjusts the brightness by changing an amount of electricity to be supplied to said light source.

36. The polishing end point detecting device as defined in claim 34, wherein said brightness adjustment device is provided with a plurality of light sources with different brightnesses and adjusts the brightness by selecting one of the plurality of the light sources to light up.

37. The polishing end point detecting device as defined in claim 34, wherein said brightness adjustment device adjusts the brightness by changing a length of an optical path from said light source to said window.

38. The polishing end point detecting device as defined in claim 34, wherein said brightness adjustment device conducts the white light which has been outputted from said light source through a stop, and adjusts the brightness by changing an amount of opening of the stop.

39. The polishing end point detecting device as defined in claim 34, further comprising a reference correcting device for correcting the light intensity spectrum of the reflected light from the reference sample based on the corrected brightness of the light source.

40. The polishing end point detecting device as defined in claim 39, wherein said brightness adjustment device adjusts the brightness by changing an amount of electricity to be supplied to said light source.

41. The polishing end point detecting device as defined in claim 39, wherein said brightness adjustment device is provided with a plurality of light sources with different brightnesses and adjusts the brightness by selecting one of the plurality of the light sources to light up.

42. The polishing end point detecting device as defined in claim 39, wherein said brightness adjustment device adjusts the brightness by changing a length of an optical path from said light source to said window.

43. The polishing end point detecting device as defined in claim 39, wherein said brightness adjustment device conducts the white light which has been outputted from said light source through a stop, and adjusts the brightness by changing an amount of opening of the stop.

* * * * *